United States Patent [19]

Traut

[11] 4,188,176

[45] Feb. 12, 1980

[54] VARIABLE DISPLACEMENT ROTARY FLUID ENERGY CONVERTER

[76] Inventor: Earl W. Traut, 8040 Palm Lake Dr., Orlando, Fla. 32811

[21] Appl. No.: 877,326

[22] Filed: Feb. 13, 1978

[51] Int. Cl.[2] ..... F01C 1/02; F01C 21/16; F03C 3/00; F04C 15/04

[52] U.S. Cl. ..... 418/24; 418/28; 418/61 B

[58] Field of Search ..... 418/24–28, 418/54, 57, 61 B

[56] References Cited

U.S. PATENT DOCUMENTS

| | | | |
|---|---|---|---|
| 302,179 | 7/1884 | Walker | 418/54 |
| 1,277,018 | 8/1918 | Wolfington | 418/61 B |
| 1,797,905 | 3/1931 | Dooley | 418/28 |
| 2,162,771 | 6/1939 | Winans | 418/61 B |
| 3,922,120 | 11/1975 | McCullough et al. | 418/61 B |

FOREIGN PATENT DOCUMENTS

| | | | |
|---|---|---|---|
| 1368365 | 6/1964 | France | 418/61 B |

*Primary Examiner*—John J. Vrablik

[57] ABSTRACT

An elongate rotor operated by a crank and rotating within a generally triangular chamber to act as a positive displacement pump or fluid motor. Sliding the rotor axially through a close-fitting hole in a plate which is free to move radially but not axially causes the displacement of the triangular chamber to vary. System fluid pressure may be used to vary the displacement.

3 Claims, 4 Drawing Figures

81b 80
81
87
86
97
84a
89
87a
88
87d
87g
88
81c

VARIABLE DISPLACEMENT ROTARY FLUID ENERGY CONVERTER

RELATIONSHIP TO PRIOR PATENT

This invention bears a definite relationship to my U.S. Pat. No. 4,008,982 entitled Rotary Fluid Energy Converter.

BACKGROUND OF THE INVENTION

Typical variable displacement pumps and motors are large in size in comparison to the amount of fluid they accommodate per revolution and must operate at high speed to handle proportionately large volumes of fluid.

SUMMARY OF THE INVENTION

The invention provides a pump or fluid motor in which a rotor, which has a crank sliding back and forth in its internal elongate slot, rotates end over end inside a generally triangular chamber. A disk surrounding the crank is adjacent one end of the rotor and includes two ports, one of which conducts fluid to the portion of the chamber and rotor slot which is increasing in volume; the other conducts fluid away from the portion of the chamber and slot which is decreasing in volume. A triangular ring surrounds the periphery of the disk and is free to slide axially within the chamber.

The other end of the rotor passes through a hole in a closely-fitting plate which rotates with the rotor but cannot move axially. Moving the rotor axially through the hole in this plate decreases the distance between the plate and the disk, thus decreasing the volume of the chamber per revolution. Increasing the distance between the plate and the disk similarly increases the displacement per revolution.

During operation as a pump or motor, fluid pressure acting inside the chamber may be used to increase the displacement per revolution. Or, system fluid pressure acting on the side of the disk and ring away from the rotor may be used to decrease the displacement.

Accordingly, it is an object of the present invention to provide a simple variable displacement rotary fluid energy converter which may be operated either as a pump or as a fluid motor.

Another object of the invention is to provide a variable displacement pump or fluid motor which efficiently uses the space it occupies to move a large volume of fluid per revolution.

Other objects of this invention will appear from the following description and appended claims, reference being had to the accompanying drawings froming a part of this specification wherein like reference characters designate corresponding parts in the several views.

FIG. 2 is a sectional view taken along line 2—2 of FIG. 1 and looking in the direction of the arrows to show the arrangement of the rotor, its internal components and the plate it passes through.

DETAILED DESCRIPTION

Figure 1:
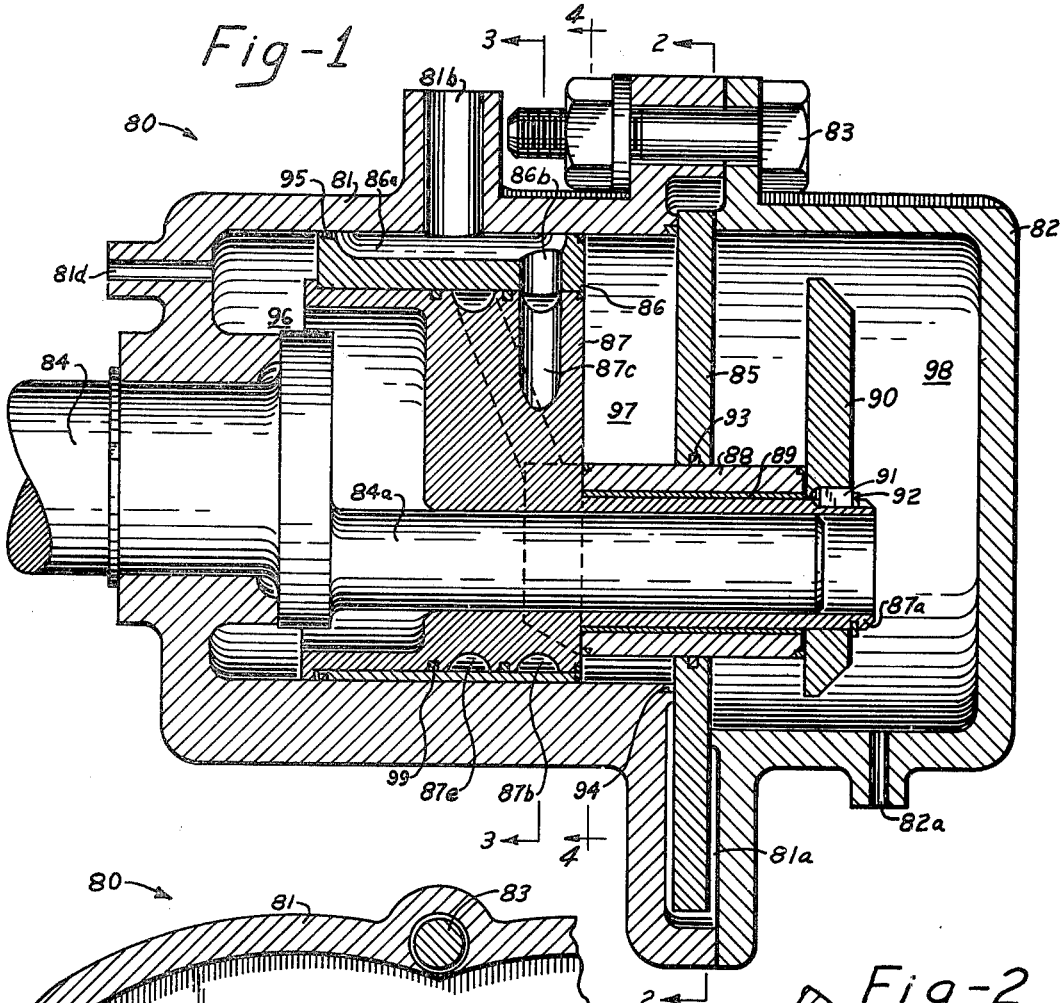
FIG. 1 is a sectional view of a variable displacement rotary fluid energy converter to show the axial arrangememt of its components.
Figure 2:
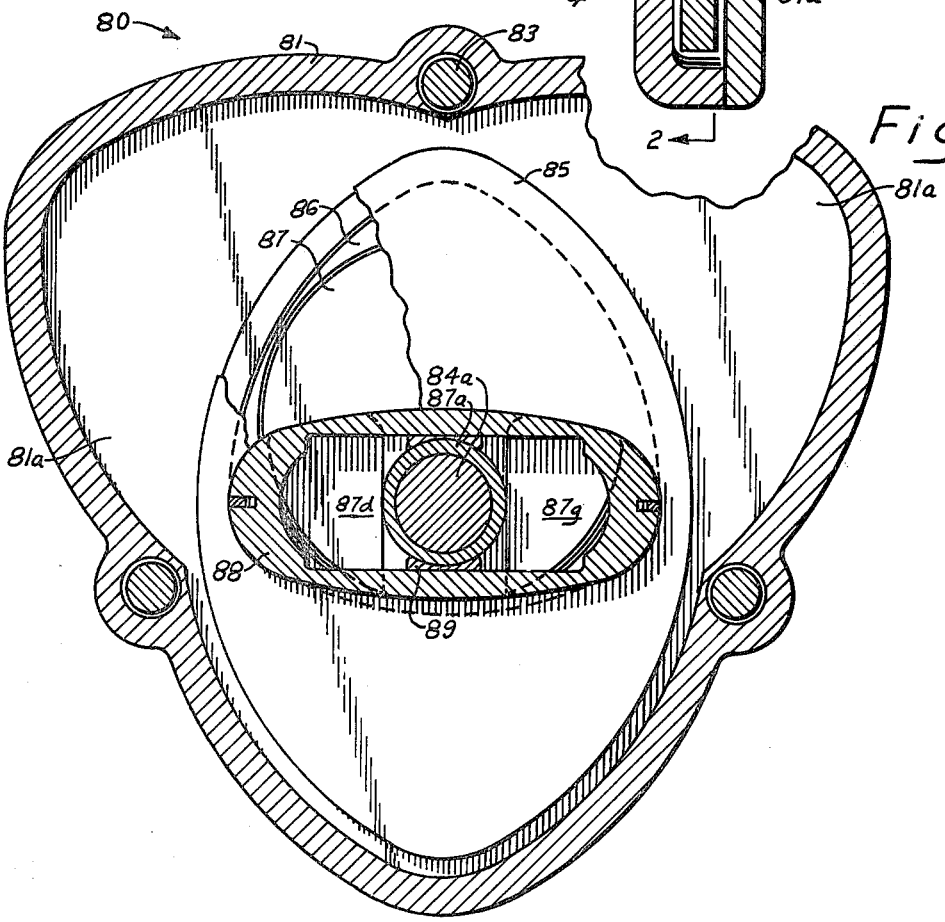
Figure 3:
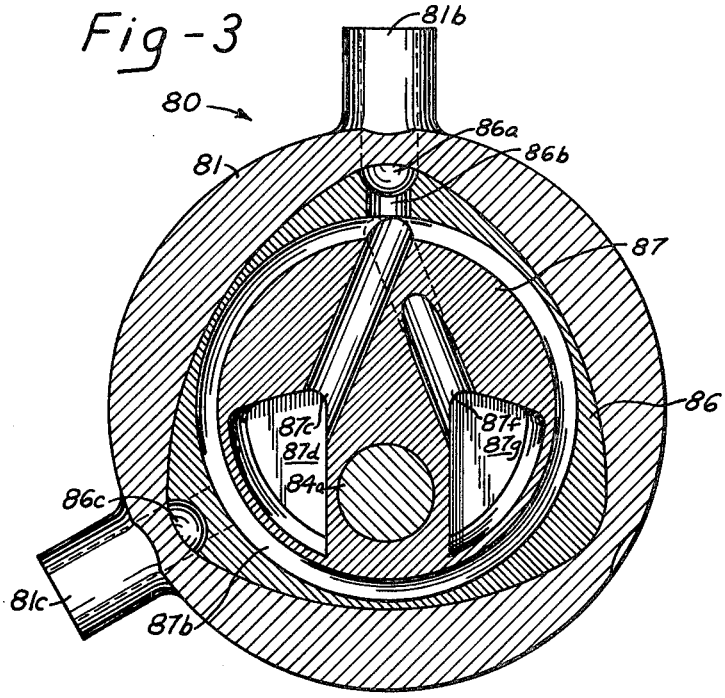
FIG. 3 is a sectional view taken along line 3—3 of FIG. 1 and looking in the direction of the arrows to show the arrangement of ducts, openings and ports to conduct fluid to and from the chamber and rotor slot.

Turning now to FIGS. 1, 2 and 3 there will be seen variable displacement rotary fluid energy converter (RFEC) 80 in which an elongate rotor rotates inside a three lobed chamber to provide a positive displacement pump or motor. Inserting one end of this elongate rotor through a radially movable plate makes its possible to change the axial length of the three-lobed chamber and thus change its displacement per revolution.

Looking primarily at FIG. 1, the stationary components include left end housing 81 and right end housing 81, which are fastened to each other by three bolts 83 and associated nuts and washers. End housing 81 supports shaft 84 and additionally includes triangular chambers 96 and 97 and an assembly of sliding components. The dynamic components include shaft 84 with affixed crank 84*a* which rotates within housing 81 and is prevented from moving axially by a snap ring, central plate 85 which closes the right end of chamber 97 and is inserted between housings 81 and 82 and is free to rotate and oscillate radially but not free to move axially, and an assembly of sliding components most of which additionally rotate. This sliding assembly includes triangular ring 86 which has the same cross-section as chambers 96 and 97, left disk 87 with its tubular axial extension 87*a*, rotor 88, rotor bearing shoes 89, right end cover 90 which seals the right end of the slot in rotor 88 to prevent escape of fluid thereat, key 91 which keeps end cover 90 aligned with axial extension 87*a*, and snap ring 92 which fastens end cover 90 to extension 97*a*.

FIG. 2 is a cross-sectional view showing that central plate 85 is generally oval and has a transverse oval hole which is shaped as the cross-section of rotor 88 so that rotor 88 can freely slide within it, seal 93 preventing fluid leakage therebetween. As rotor 88 intermittently rotates within the triangular portion of left end housing 81, central plate 85 slides in and out of the three lobes 81*a* of housing 81. In FIG. 1, seal 94 prevents leakage of fluid between central plate 85 and housing 81.

Triangular ring 86 does not rotate but slides axially within housing 81. Ring 86 moves axially with disk 87, being held in position on it by the lip on the left edge of disk 87 and by the left side of rotor 88. Ring 86 and disk 87 close the left end of chamber 97. As can best be seen in FIG. 3, ring 86 includes two longitudinal slots 86*a* and 86*c*, located in two of its three corners. Longitudinal slot 86*a* provides communication between fluid opening 81*b* through hole 86*b*, annular groove 87*b* and duct 87*c* to port 87*d* in the side of disk 87 which faces chamber 97. Longitudinal slot 86*c* similarly provides communication between fluid opening 81*c* through a hole to annular groove 87*e* and duct 87*f* to port 87*g*. Seals 95 prevent fluid leakage between ring 86 and housing 81. Seals 99 prevent leakage between ring 86 and disk 87.

Figure 4:
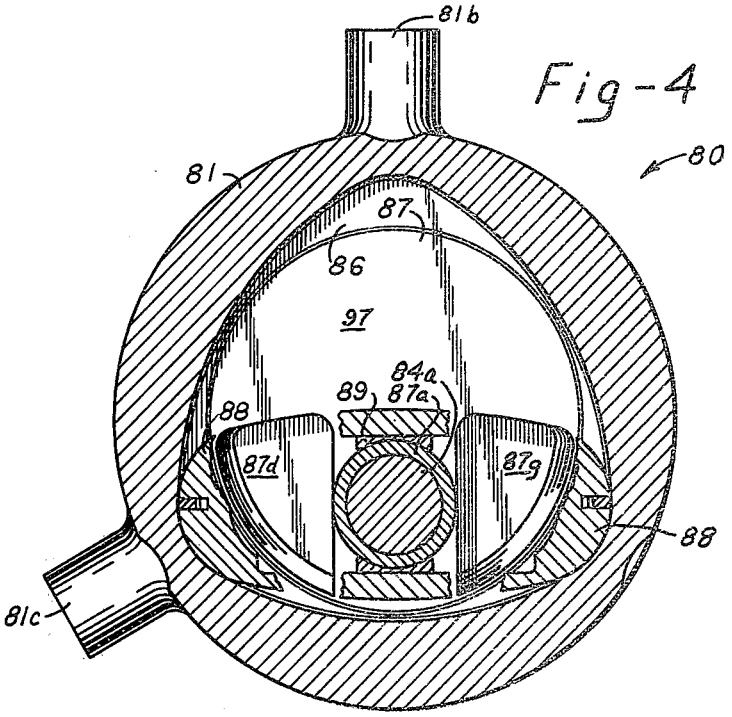
FIG. 4 is a sectional view taken along line 4—4 of FIG. 1 and looking in the direction of the arrows, with portions of the rotor broken away to reveal the shape and location of the ports which conduct fluid to and from the chamber and rotor slot.

Looking primarily at FIG. 4, when RFEC 80 is operated as a fluid motor, fluid under pressure passes through port 87*d* into the rotor 88 slot cell on the left side of crank 84*a*, causing it to move to the right. This causes the right end of rotor 88 to begin to move upwards and thus expose the lower corner of port 87*d* to the compartment of chamber 97 which is below rotor 88, so that pressurized fluid now begins to force the right end of rotor 88 upwards. At the same time, the upper portion of port 87*g* begins to communicate with the chamber 97 compartment above rotor 88, thus enabling spent fluid above rotor 88 and in the right cell of rotor 88 slot to depart via port 87*g*. After 120° of crank 84*a* rotation and a corresponding 30° of rotor 88 rotation, crank 84*a* has reached its maximum travel in the rotor 88 slot, and port 87*d* no longer contacts the left rotor 88 slot cell but is almost in contact with the rotor 88 slot cell on the right side of crank 84*a*. During the next 120° of crank 84*a* rotation and 30° of rotor 88 rotation, fluid entering the right slot cell of rotor 88 forces crank 84*a* to the left and fluid entering the portion of chamber 97 under rotor 88 continues to force rotor 88 upwards. When rotor 88 reaches its maximum travel and is adjacent the left wall of triangular chamber 81, its position with respect to this left wall is the same as it was to the lower wall of chamber 81 in FIG. 4; and the position of ports 87*d* and 87*g* with respect to rotor 88 will also be the same. Two more 240° units of crank 84*a* rotation and 60° of rotor 88 rotation will again position rotor 88 as shown in FIG. 4.

Note that port 87*d* is shaped and positioned so that it always communicates with the rotor 88 slot cell and the chamber 97 compartment which is increasing is size; whereas port 87*g* always communicates with the rotor 88 slot cell and chamber 97 compartment which is decreasing in size. Note also that fluid could oppositely enter via port 87*g* and exit via port 87*d*, in which event crank 84*a* would rotate in the opposite direction.

When RFEC 80 is operated as a pump, rotation of shaft 84 causes fluid to enter via either port 87*d* or 87*g*, depending upon the direction of rotation, and depart via the other port. Additional discussion of the action of the crank and rotor within the chamber, and means of assuring only one direction of rotor rotation may be found in my U.S. Pat. No. 4,008,982 entitled Rotary Fluid Energy Converter.

Whether RFEC 80 is operated as a pump or motor, the combined surface area of the left end of ring 86 and disk 87 is greater than that portion of their right ends subjected to fluid pressure. So, if control chamber 96 is subjected to supply fluid pressure through duct 81*d*, the sliding assembly is forced to the right and the displacement of chamber 97 decreases. Conversely, if fluid is permitted to escape control chamber 96, fluid pressure in chamber 97 forces the sliding assembly to the left and the displacement of chamber 97 increases. Blocking duct 81*d* will cause the displacement of chamber 97 to remain constant. Chamber 98 is circular and is vented through opening 82*a*.

Control of RFEC 80 as either a fluid pump or motor may be accomplished by using a three-way valve, such as a spool valve, the port adjacent the center of such valve being connected to duct 81*d* and normally being closed. Moving the spool in one direction would connect duct 81*d* to the fluid return reservoir, thereby permitting fluid to drain from chamber 96 and causing the displacement of chamber 97 to increase. Moving the spool in the opposite direction would permit fluid under pressure to enter chamber 96, resulting in a decrease in chamber 97 displacement. Conventional means of providing constant speed, constant flow rate or constant pressure may be readily adapted to RFEC 80. Mechanical or electromagnetic means may also be used to vary displacement.

I claim:

1. A variable displacement rotary fluid energy converter comprising:

a rotor, said rotor being elongate and including a longitudinal slot, a generally triangular chamber, a crank, said crank moving back and forth in said longitudinal slot as said rotor rotates end over end within said chamber, a central plate, said plate serving to close one end of said chamber and being free to move radially and not free to move axially, said plate including an elongate hole shaped as the cross-section of said rotor and surrounding same, said rotor being free to slide axially in said elongate hole, a ring, the outer periphery of said ring being generally triangular as the cross-section of said chamber and located in same, a disk, said disk including a hole through which said crank passes, said disk being free to rotate with said crank inside said ring, said disk including porting means to conduct fluid to and from said chamber and said longitudinal slot, said disk and said ring serving to close the other end of said chamber and being free to slide axially with said rotor, so as to vary the displacement of said chamber per revolution of said rotor.

2. The variable displacement rotary fluid energy converter as described in claim 1 in which said porting means comprises an inlet port and an outlet port, said inlet port being in continuous communication with the portion of said chamber and said slot which is increasing in size, said outlet port being in continuous communication with the portion of said chamber and said slot which is decreasing in size.

3. The variable displacement rotary fluid energy converter as described in claim 1 in which a triangular control chamber is included, said control chamber being located on the side of said ring and said disk axially opposite from first named triangular chamber, said control chamber including a duct through which fluid may pass to change the displacement of said chamber per revolution of said rotor.

* * * * *